US006220631B1

(12) United States Patent
Pritchard et al.

(10) Patent No.: US 6,220,631 B1
(45) Date of Patent: Apr. 24, 2001

(54) STABILIZING SKEG DEVICE

(75) Inventors: John C. Pritchard; Lizlott Pritchard, both of Thousand Oaks, CA (US)

(73) Assignee: Doink, Incorporated, Thousand Oaks, CA (US)

( * ) Notice: Subject to any disclaimer, the term of this patent is extended or adjusted under 35 U.S.C. 154(b) by 0 days.

(21) Appl. No.: 09/608,278

(22) Filed: Jun. 30, 2000

Related U.S. Application Data

(63) Continuation of application No. 09/465,923, filed on Dec. 17, 1999, now abandoned, which is a continuation of application No. 08/922,855, filed on Sep. 3, 1997, now Pat. No. 6,007,101.

(51) Int. Cl.[7] ..... A63C 17/00
(52) U.S. Cl. ..... 280/809; 280/14.2
(58) Field of Search ..... 280/14.21, 14.22, 280/28, 28.11, 604, 605, 606, 809

(56) References Cited

U.S. PATENT DOCUMENTS

| | | | | |
|---|---|---|---|---|
| 4,116,455 | * | 9/1978 | Dotson | 280/14.21 |
| 4,896,843 | * | 1/1990 | Shumazs et al. | 280/14.21 |
| 5,156,644 | * | 10/1992 | Koehler et al. | 280/14.21 |
| 5,161,810 | * | 11/1992 | De Cesare | 280/14.21 |
| 5,356,164 | * | 10/1994 | Ozbarn | 280/14.21 |
| 5,816,002 | * | 10/1998 | Hagashi | 280/14.21 |

* cited by examiner

*Primary Examiner*—Richard M. Camby
(74) *Attorney, Agent, or Firm*—Kolisch Hartwell Dickinson McCormack & Heuser

(57) ABSTRACT

Skeg structure for a snow-traveling device, such as a snowboard, a ski, and the like including structure appropriate for anchoring to such a device, a deployable, movable skeg blade, and mounting structure which is associated with that blade that promotes adjustable, travel-limited, yieldable, spring-biased motion of the blade relative to an associated snow-traveling device, and specifically, relative to the underside, snow-contacting surface in that device.

18 Claims, 5 Drawing Sheets

D1
D2
D3

64
64d
64a
64b 64
64a
64b 8A, 8B
64
64a
64d
64e
64c
64b
8A, 8B 30
66
66b
66c
68
66a
108

70

Fig. 17
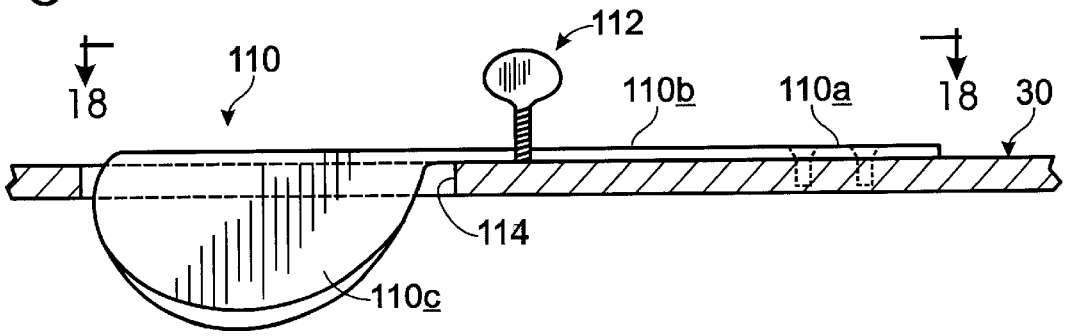
Fig. 18
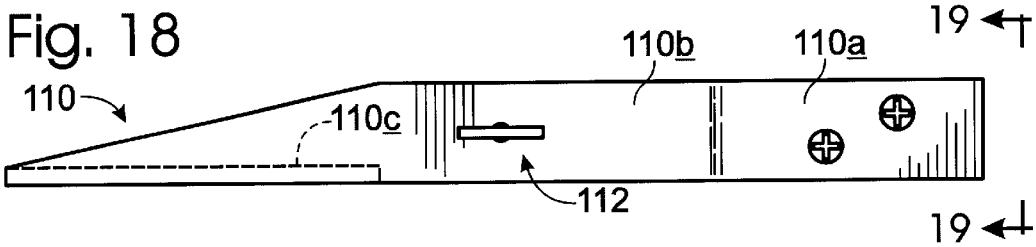
Fig. 19
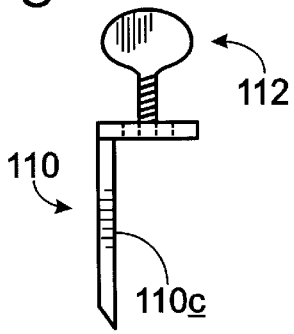
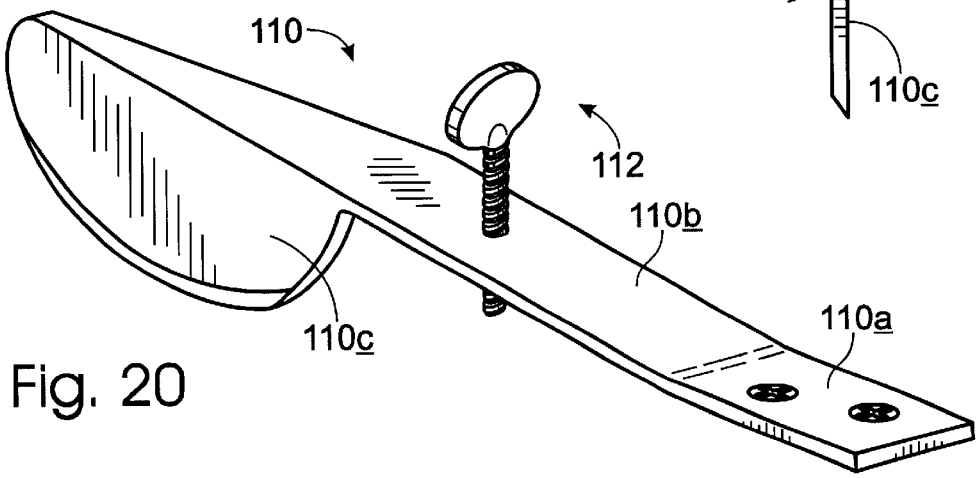
Fig. 20

STABILIZING SKEG DEVICE

CROSS REFERENCE TO RELATED APPLICATION(S)

This application is a continuation of applicants' patent application Ser. No. 09/465,923 filed Dec. 17, 1999 for "Stabilizing Skeg Device" now abandoned, which is a continuation of Ser. No. 08/922,855 filed Sep. 3, 1997 now U.S. Pat. No. 6,007,101.

BACKGROUND AND SUMMARY OF THE INVENTION

This invention relates to an improved performance stabilizer for snowboards, skis and other related snow-travel devices, and more particularly, to an adjustable, skegdeployable skeg structure that functions to improve the maneuverability, the tracking and the stability of such devices which travel on and over a snow surface. For the purpose of disclosure herein, a preferred embodiment, and certain modifications, of the present invention are described chiefly in the realm of snowboards with respect to which the invention has been found to offer particular utility.

As is pointed out in the companion, underlying patent-application history from which this present application continues, and focussing especially on snowboards, such boards in recent years have become increasingly popular sporting devices. For a large number of reasons, snowboards afford opportunities for movement and maneuverability over a snow surface which offer a variety of interesting dimensions to snow-sporting activities. In the context of such activities, there is a great deal of interest in equipping a board, like a snowboard, with configurations, devices, etc. that can offer a range of subtle, sophisticated, and dramatic maneuvering and control capabilities. Especially, there is a strong interest in having the versatility of adaptability in the performance of snowboards to meet numerous, different snow conditions.

The stabilizer/skeg structure of the present invention addresses several of these interests and desirabilities in ways which offer a very high degree (and range) of maneuverability, control and adjustability. It does so in a relatively simple structural arrangement which can either be employed as an "add-on" system for an otherwise conventional snowboard (or other snow devices), or as a system initially integrated (as wholly as possible) into the body of a snowboard.

According to the invention, proposed thereby, in several modifications, is a skeg structure that is adapted for mounting either as an individual, or as part of a plurality of like structures, on and with respect to the body of a snowboard, or a like device. This skeg structure, in one of its preferred add-on forms, includes (a) a base (also referred to as an anchor structure) that is readily securable to a board at different selected locations, (b) a skeg blade which is deployable (either through a slot-like opening in the body of a board, or as an outrigger structure) to offer different levels of downward projection (for snow-surface penetration and engagement) from the undersurface (also referred to as the underside, snow-contacting surface) of a board, and (c) an appropriate mounting structure which mounts the blade on the base in such a manner as to accommodate adjustable, and relatively widely variable, blade deployment in the manner just suggested. The blade motion which is accommodated by this mounting structure is also referred to herein as adjustable, travel-limited, yieldable, spring-biased motion. The proposed skeg structure is one wherein the skeg blade normally operates with quickly responsive, vertically moveable (rotational and/or linear translational) reaction to an underlying snow surface, and against the action (variable, if desired) of a suitable biasing spring. Such a spring allows the blade to shift with yielding reaction in order to accommodate changing, underlying snow conditions as a board travels over snow. Additionally, and according to the invention, the user is afforded an ample opportunity to control the nominal degree of initial, non-reactive deployment which a blade exhibits in the absence of contact with snow.

Among the preferred embodiments of the invention that are illustrated and described herein, certain ones employ, in the mounting structure for a blade, a rotatable shaft having a polygonal, cross-sectional, skeg-blade-receiving end that fits within a generally matching, polygonal receiving socket in the blade. This shaft and socket arrangement supports the blade in a locked, positive-drive manner, permitting rotary blade deployment, and appropriate, responsive yield reaction, with the blade and shaft operating under all circumstances as a substantially fixed-configuration unit. With this positive-drive feature of the invention present, there is essentially no opportunity for the blade to become loosened from the shaft in any manner that would permit it to rotate relative to the shaft. Such a "locked" arrangement is advantageous in certain kinds of snowboarding conditions.

Another feature offered by the present invention involves a blade construction per se which is generally thin and planar, but which is characterized by a very gentle taper progressing outwardly into the expanse of the blade away from the point at which the blade is mounted (through the rotatable shaft in the mounting structure) on the base. This tapered arrangement may either be a simple taper that is defined by the convergence of two planes slightly angled relative to one another, or, in the context of a further modification, by a plurality of converging planes, such as three or more planes, which define a blade characterized with a stepped, or differential, bevel configuration.

Such a beveled construction enhances what might be thought of as the knife-like performance of the blade as such engages underlying snow. This kind of construction is considered to offer interesting performance advantages under certain kinds of snow conditions.

Yet another modification proposed by the present invention includes a deployment biasing and adjustment structure, or mechanism, which sets the nominal degree of downward projection, i.e., projection from the undersurface of a snowboard, utilizing a relatively moveable cam and follower structure. Such a structure offers a very high degree of fine control over deployment, and is one which is relatively simple in construction. Within such a cam and follower arrangement, there is disclosed herein an embodiment wherein the cam structure takes the form of a rotary cam element, which element is mounted on the base in the skeg structure, and includes a sloped cam surface. Spring-biased detent structure is interposed the cam element and the base so as to permit releasable detent latching, or catching, of the element in different, rotated, angular positions. The follower in the cam and follower structure takes the form, as disclosed herein, of a unit anchored for rotation with a shaft that mounts a blade for rotational deployment. This follower has a projecting finger (also called a finger-like projection) that rides on the cam surface in the cam element. The upper surface of the cam element may, if desired, be furnished with follower-receiving, preselected registry indentations or depressions which may be disposed angularly on the cam surface in a relationship that ties in with the location of components in the detent structure just mentioned.

Still another important embodiment of the invention proposes a skeg structure including a unitary, combined skeg blade and mounting structure, wherein a skeg blade is formed as a portion of an elongate, springy, reed-like device (also called herein a common spring-reed component). A slider is employed to adjust the projection deployment of the blade, with such adjustment relating to the slider's position along the length of the "reed portion" of the device. The slider acts in a wedged condition between this reed portion and the mounting base in the skeg structure. Spring force exerted by bending in the reed portion can be adjusted as well, and via another slider which can be selectively positioned to define a nip region bracketing the reed portion effectively between this second-mentioned slider and the mounting base.

In various embodiments of the invention, the spring force which acts yieldably to permit blade movement necessitated by travel over and in a snow surface is adjustable.

Still a further important embodiment of the skeg structure of the present invention features a deployable skeg blade which can move in a defined, linear, plunger-like manner.

Various other features and advantages that are offered and attained by the present invention will become more fully apparent as the description which now follows is read in conjunction with the accompanying drawings.

BRIEF DESCRIPTION OF THE DRAWINGS

FIGS. 7 and 8A are to be viewed and read together as an illustration of one of these two modified blades, and FIGS. 7 and 8B together as an illustration of the other modified blade. Each of these two modified forms of blades is characterized as having a stepped, differential-bevel configuration. FIGS. 8A, 8B are partial sectional views taken generally along the line 8A, 8B–8A, 8B in FIG. 7.

FIGS. 17–20, inclusive, show yet a further modified form (i.e., a reed-like form) of the skeg structure of the present invention. These four figures are drawn with roughly the same scale chosen for FIG. 11.

DETAILED DESCRIPTION OF, AND BEST MODE FOR CARRYING OUT, THE INVENTION

Figures 1, 2, 3, 4, 5, 6:
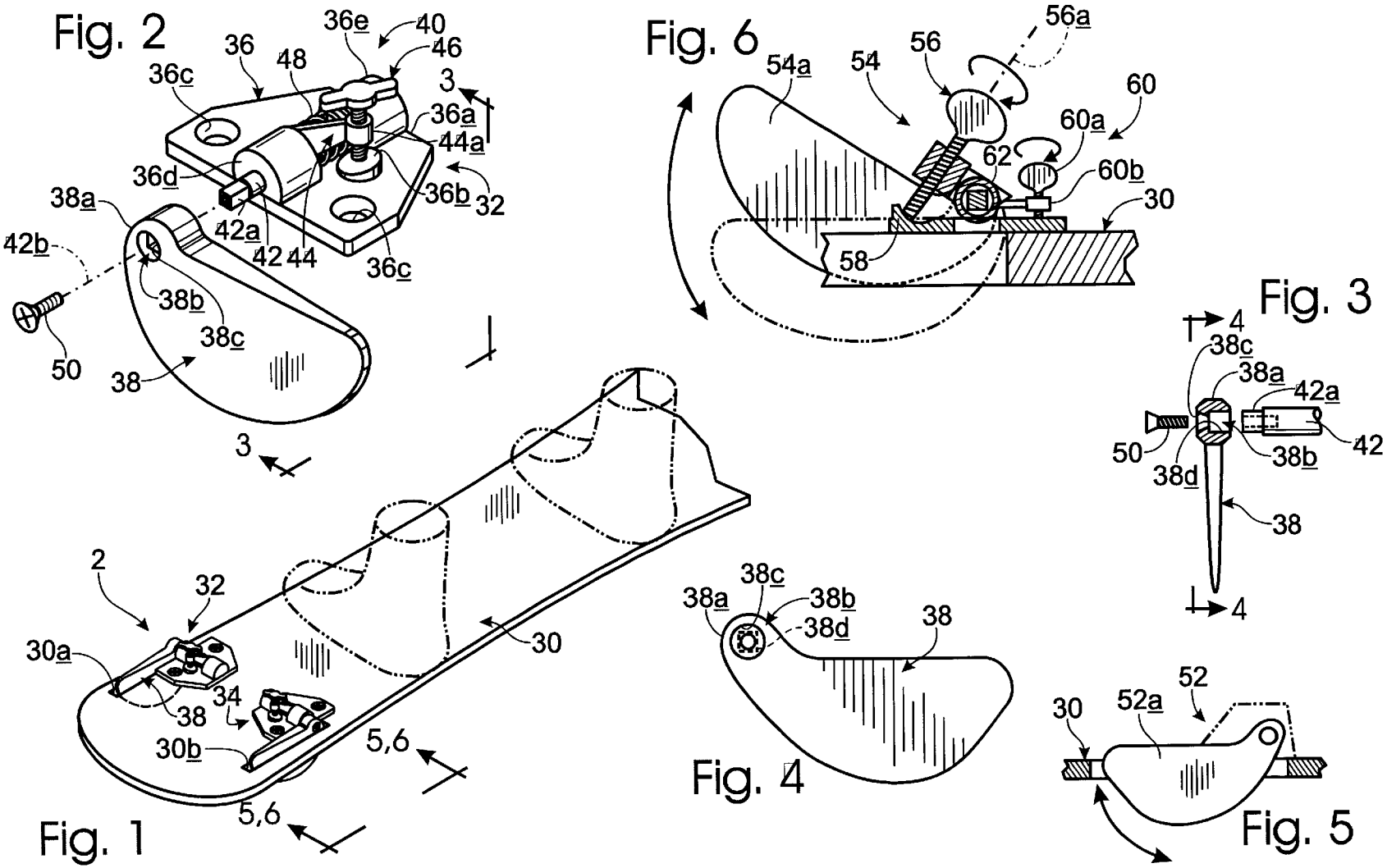
FIG. 1 is a fragmentary, rear-end perspective view of a snowboard equipped with plural skeg structures constructed in accordance with one preferred embodiment of the present invention. Specifically, this board is shown to be equipped with one pair of rearend-disposed, laterally outwardly positioned skeg structures having blades that operate through slots provided on opposite sides of the board. Blades in these two skeg structures are movably (rotationally) deployable through these slots.
FIG. 2 is an isolated and exploded perspective view of the particular skeg structure that is pointed to by serpentine arrow 2 in FIG. 1. This view, which is taken generally in the direction indicated by arrow 2, is on a scale which is larger than that employed in FIG. 1.
FIG. 3 is an exploded view taken generally along the line 3—3 in FIG. 2, illustrating several isolated components that are present in the skeg structure of FIG. 2.
FIG. 4 in an elevation taken generally along the line 4—4 in FIG. 3.
FIG. 5 is a simplified, fragmentary view on a slightly smaller scale than that employed in FIGS. 2–4, taken generally along the line 5, 6—5, 6 in FIG. 1, showing generally a modified skeg structure which includes an outrigger-type skeg blade in a condition of full deployment.
FIG. 6 is a view, on about the same scale as that used in FIGS. 2–4, also taken generally along line 5,6—5,6 in FIG. 1, showing another modified form of skeg structure.

Turning now to the drawings, and referring first of all to FIGS. 1–4, inclusive, indicated generally at 30 in FIG. 1 is the rear end portion of an otherwise conventional snowboard. Mounted on this end of board 30 are two skeg structures 32, 34 which are constructed in accordance with a preferred embodiment of the present invention. As will be more fully explained. These two skeg structures, which are effectively mirror-image structures, are mounted as by screws on the upper surface of the board, immediately adjacent two, elongate (longitudinally extending) through-body slots 30*a*, 30*b* which are associated, respectively, with structures 32, 34. It is through these two slots that the skeg blades contained in structures 32, 34 are deployed. Structures 32, 34 take the form of what are also referred to herein as add-on type structures, in the sense that they can be acquired separately and mounted later, in relation to the date of board construction.

FIGS. 2–4, inclusive, illustrate details of the construction of the skeg structure 32. As was previously mentioned, structures 32, 34 herein are mirror-image structures, but in all other respects are substantially identical. Accordingly, the description which now follows that relates to skeg structure 32 can be viewed as being also a full constructional and operational description of skeg structure 34.

Thus, included within skeg structure 32 are an anchor structure 36, a skeg blade 38 and mounting structure (also referred to herein as deployment biasing and adjustment structure) 40 which is operatively interposed blade 38 and anchor structure 36.

Mounting structure 36 includes a mounting base plate 36*a* having an upwardly projecting boss 36*b* which plays a role in deployment adjustment, and two screw-accommodating board-mounting apertures 36*c*. It is via apertures 36*c* that screws (not shown) are employed to anchor structure 32 onto a board, such as snowboard 30.

Rotatably received within a pair of spaced journal structures 36*d*, 36*e* which form part of base plate 36*a* is an elongate, rotatable shaft 42 having a skeg-blade-receiving end 42*a* which projects generally toward the viewer in FIG. 2. End 42*a* is formed with a polygonal perimetral structure, as such structure is viewed effectively along the long axis 42*b* of shaft 42, which perimetral structure is generally square in shape. Shaft 42 is also referred to herein as a loadable/unloadable biasing element.

Suitably anchored to shaft 42 in the region therealong which extends between journal structures 36*d*, 36*e* is a laterally projecting arm structure 44. The outer portion of this arm structure includes, in a projection 44*a*, an internally threaded through-bore which threadably receives a deployment adjustment screw (also called an adjustment structure) 46 whose lower end in FIG. 2 nominally engages the upper surface of previously-mentioned boss 36*b*. Operatively, interposed arm 44 and base plate 36*a* is a coiled biasing spring 48. This spring, which resides in a loaded (non-relaxed) condition in the skeg structure, rotationally urges arm 44 for clockwise rotation along with shaft 42*a* about axis 42*b*. The limit position for such rotational bias in skeg structure 32 is defined by the particular adjusted (threaded) condition of adjustment screw 46 within projection 44*a*. Recalling that, as was mentioned earlier, the lower end of screw 46 nominally tends to rest upon, and in force-biased contact with, the upper surface of boss 36*b*, it will become apparently shortly that manipulation of screw 46 establishes the nominal deployment condition for blade 38. This condition is referred to herein as a yieldably biased deployment condition. In the absence of any external force tending to disrupt such a nominal "rest" condition, the components in the mounting structure in skeg structure 32 remain positioned in the manner defined by the condition of screw 46 relative to projection 44*a*.

According to one of the special features of the present invention, and in relation to the squared end 42*a* (also called herein a positive drive structure) in shaft 42, blade 38 is locked into a positive-drive relationship with shaft 42, in which condition acts as a single unit with the shaft. Blade 38, which has the perimetral configuration generally illustrated in FIGS. 2 and 4, includes a mounting region 38*a* which is furnished with an elongate through-passage 38*b*. The near end 38*c* of passage 38*b* in FIGS. 2 and 4, which end appears in FIG. 3 as the left side of blade 38, is generally conically shaped This end communicates with a squared, rectangular (polygonal) passage socket 38*d* that lies at the opposite end of the passage. The perimetral outline of socket 38*d* substantially matches (in a clearance-fit manner) the outer configuration of shaft end 42*a*, whereby, with this shaft end inserted into socket 38*d* (the mounted condition for blade 38 in structure 32), the blade and the shaft are positively, drivingly locked to one another against any possibility of relative rotation about the long axis of arm 42. A screw 50 shown in FIGS. 2 and 3 functions to anchor blade 38 into such a condition on end 42*a* in shaft 42.

This positive-drive interconnection which is thus provided for blade 38 relative to shaft 42 in the skeg structure now being described, is a feature which securely anchors the blade on the shaft against relative rotation. Importantly, it thus guards against unwanted angular "slippage" during use with a snowboard. While, in the particular structure now being described, a square, perimetral outline is defined and illustrated for shaft end 42*a* and for socket 38*d*, it should be understood that other faceted, polygonal shapes could be chosen, each one of which would furnish essentially the same kind of positive drive connection between the blade and the shaft.

During operation, preselected, nominal blade deployment through the associated slot in board 30 (slot 30*a*) is implemented through operation of screw 46. Biasing spring 48, under nominal conditions, i.e., under conditions where substantially no external force is applied to blade 38, keeps the blade and shaft in a releasably stale and appropriate fixed positions. When blade 38 engages a snow surface on the underside of board 30, it is permitted, as needed, to yield and to swing upwardly through slot 30*a* against the biasing action of spring 48. This blade motion for blade 38 is referred to herein as arcuate, pivotal motion of the blade relative to base 36. The term "arcuate" is used herein to describe motion which is generally curvilinear. The term "pivotal" is employed to describe a special case of arcuate motion—namely one which occurs with respect to a pivot axis or the like. As illustrations of the intended meanings of these two terms, the motion generally of the end of an elongate element as such is bent along its long axis is arcuate motion which is not necessarily pivotal motion. The swinging of, for example, of a door on hinges is arcuate motion which is also pivotal motion.

Blade 38 will not slip in relation to its angular condition on shaft 42. When the particular external-force condition that produces such a yieldable deflection in blade 38 goes away, spring 48 reliably returns the blade exactly to the user-prechosen, nominal deployment for blade 38—such being defined by engagement of the bottom end of screw 46 on the upper surface of boss 36*b*. No amount of normal blade deflection (as a consequence of engagement with different kinds of underlying snow surfaces) will ever cause the blade to become unlocked from the angular position initially chosen for it on shaft 42.

Addressing attention now to FIG. 5, here there is shown generally, and in a very simplified form at 52, a modified form of pivotal-blade skeg structure mounted on the rear end of board 30. Structure 52 includes a deployable, spring-biased and reactable skeg blade 52*a* which, instead of extending downwardly through an accommodating through-body slot in the board, resides as an outrigger structure on that side of board 30 which is facing the viewer in FIG. 5. In all other respects, the other structure present in skeg structure 52 is like that which has just been described for skeg structure 32.

FIG. 6 illustrates another modified form of pivotal-blade skeg structure designated at 54. In many ways, skeg structure 54 is like skeg structure 32. Here, however, an elongate deployment adjustment screw 56, which is the counterpart of previously-mentioned adjustment screw 46, has its lower end acting on a specially shaped boss structure 58 which has, on its upper surface, the curvature clearly pictured in FIG. 6. With this structural arrangement, one can see that the bottom end of screw 56 substantially always engages (when it does so engage) the curved surface of boss 58, so as to have the long axis 56*a* of the threaded portion of screw 56 substantially normal to a tangent to the curvature of boss 56 at the point of contact. Such an arrangement provides a very sure footing for engagement between screw 56 and boss 58.

Skeg structure 54 also includes another modification which takes the form of a biasing-force screw-adjustment structure 60, including an adjustment screw 60*a* which is threadably received in a suitable threaded through-bore in a collar 60*b*. Collar 60*b* is appropriately anchored to one of the ends of a coiled biasing spring 62 that is the counterpart of previously-mentioned biasing spring 48. The lower end of screw 60*a* engages the upper surface of the mounting base provided in skeg structure 54. And rotational adjustment of this screw (at the selection of the user) is effective to change the biasing force applied by spring 62 ultimately to the deployable skeg blade 54*a* provided in skeg structure 54.

Figures 7, 8A, 8B, 9, 10, 13, 16:
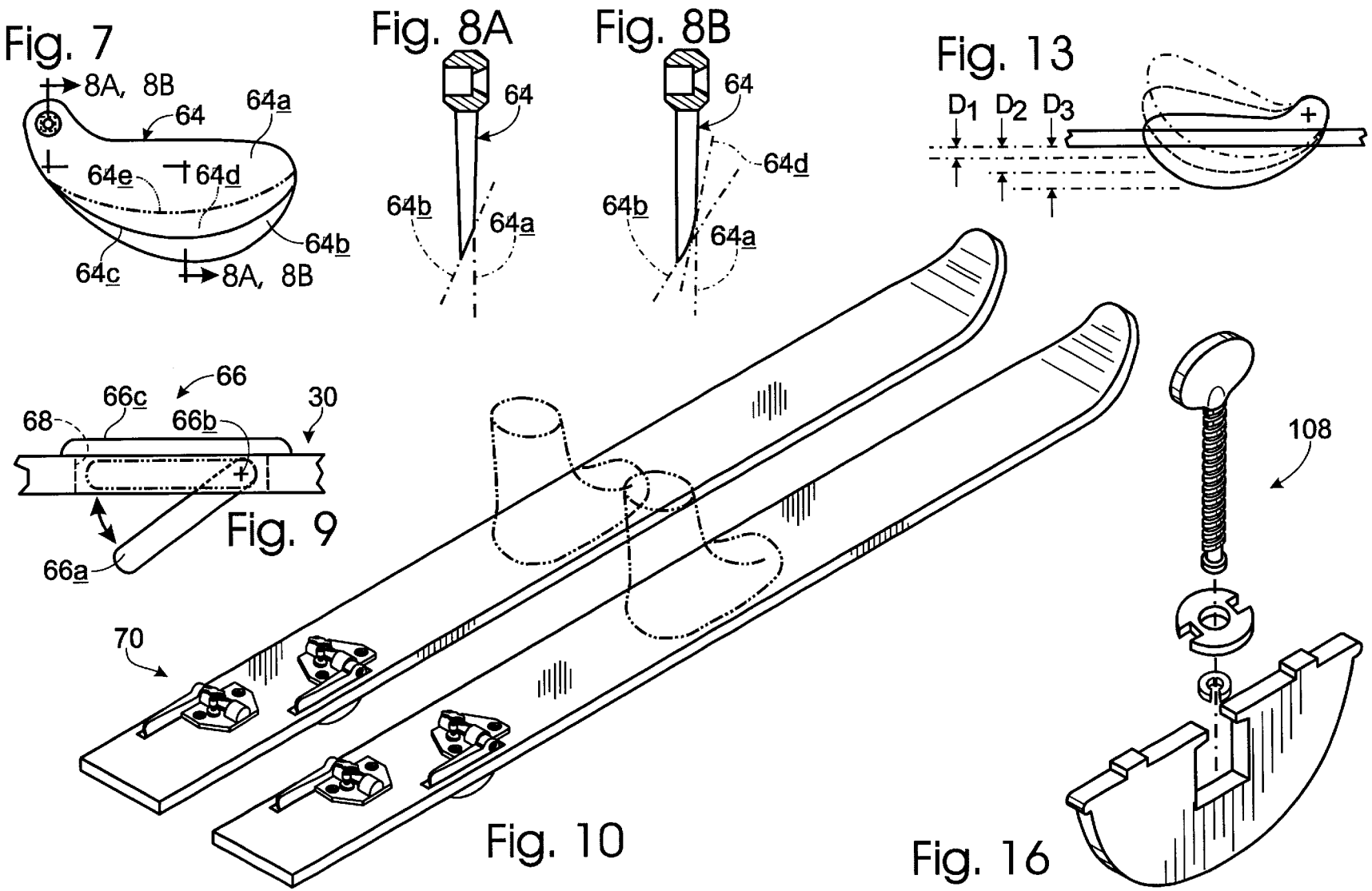
FIGS. 7, 8A and 8B are views, each on a scale which is slightly larger than that present in FIG. 6, illustrating, in an isolated fashion, two modified forms of a rotary, deployable skeg blade constructed in accordance with the invention.
FIG. 9 is a view similar to that presented in FIG. 5, on a different scale, and showing (in simplified form) a modified skeg structure which includes many components carried, effectively, within the body of a snowboard.
FIG. 10 is a perspective view like that pictured in FIG. 1, drawn on a scale which is substantially the same as the one chosen for FIG. 1, and illustrating skeg structures (four) constructed in accordance with the present invention as employed with skis.
FIG. 13 is a simplified, smaller-scale, side view of the skeg structure shown in FIGS. 11 and 12, generally illustrating three, different, pre-defined, "nominal" deployments offered by this skeg structure.
FIGS. 14–16, inclusive, present, each on a scale similar to that used in FIG. 11, three different views of another modified form (i.e., a "plunger" form) of the invented skeg structure.

Turning attention now to FIGS. 7, 8A and 8B, here, depending upon the specific chosen one of two ways of reading these views together, there are illustrated two modified forms of pivotal skeg blades constructed in accordance with the present invention—each possessing a tapered, broad-area, somewhat planar expanse. This expanse is also referred to herein as a stepped, differential-bevel configuration which is defined by plural, slightly angularly infused, converging planes present on one side (the near side in FIG. 7) of the blade. FIGS. 7 and 8A should be read together (with regard to the solid lines pictured in those two figures) as an illustration of a single-stepped (two-plane) configuration. FIGS. 7 and 8B should be read together (with attention in FIG. 7 focused both on the solid lines used therein and on the dashed-double-dot line therein) as an illustration of a duel-stepped (three-plane) configuration.

Thus, and directing attention initially toward FIGS. 7, 8A together, here there is shown a modified pivotal skeg blade 64 having, as can be seen with FIGS. 7 and 8A read together, a single-stepped, two-plane, tapered configuration, wherein the side of the blade that faces the viewer in FIG. 7 (the side which appears at the right side of FIG. 8) being defined by the two planes designated 64*a*, 64*b*. Planes 64*a*, 64*b* intersect at a shallow angle along the solid line shown at 64*c* in FIG. 7.

FIGS. 7 and 8B, as read together, illustrate a blade 64 having that same side of the blade just specifically referred to (i.e., the side facing the viewer in FIG. 7) defined by three planes of intersection, including previously-mentioned planes 64*a*, 64*b*, and a new plane pictured at 64*d*. Planes 64*a*, 64*d* intersect along the line shown as a dash-double-dot line presented at 64e in FIG. 7.

A blade constructed in accordance with either one of these two modifications presents to a snow surface an edge which is more knife-like than that which is presented by the previously-described skeg blades. Such a differential, tapered configuration offers advantages in certain kinds of snow/ice conditions, wherein the presence of blade "knife" action is important to assuring proper penetration of the underlying snow surface.

With attention now directed to FIG. 9, here there is shown, generally from the same point of view as that taken in FIG. 6, another modified, pivotal-blade 66 form of skeg structure which is constructed in accordance with the present invention. Specifically what is shown here, in a very simplified form, is a non-add-on type of construction according to the invention regarding which construction substantially all of the operational components of the system are contained, so-to-speak, well within, and principally within, a suitable internal area 68 provided within the body of a device, such as snowboard 30. Appropriate sizes for the various components of any one of the several different skeg-structure modifications that have been described so far herein can be chosen in order to allow such internal placement. And, there are many different ways of accomplishing this, all of which are well within the skills of those skilled in the relevant art. In FIG. 9, structure 66 is shown including a somewhat narrow-profile skeg blade 66*a*. Blade 66*a* deploys rotationally (pivotally) about and with respect to an axis shown at 66*b*. Skeg structure 66 is further illustrated as including a low profile cover 66*c* which is suitably secured to board 30 overhead the other components in structure 66 in board 30.

As was mentioned earlier, the skeg structure of the present invention is suitable for use with a variety of snow traveling devices. Specifically pictured in FIG. 10 is a rendition of this invention as units incorporated with the rear ends of otherwise conventional skis, shown generally at 70. Each of the two skis presented in FIG. 10 is furnished with a pair of skeg structures, each of which is very much like previously described skeg structure 32. In the ski arrangement pictured, rotationally deployable skeg blades are received and movable within and through body slots provided on opposite lateral sides of the skis, the two skeg structures provided for each ski are slightly longitudinally offset on the bodies of the skis.

Figure 11:
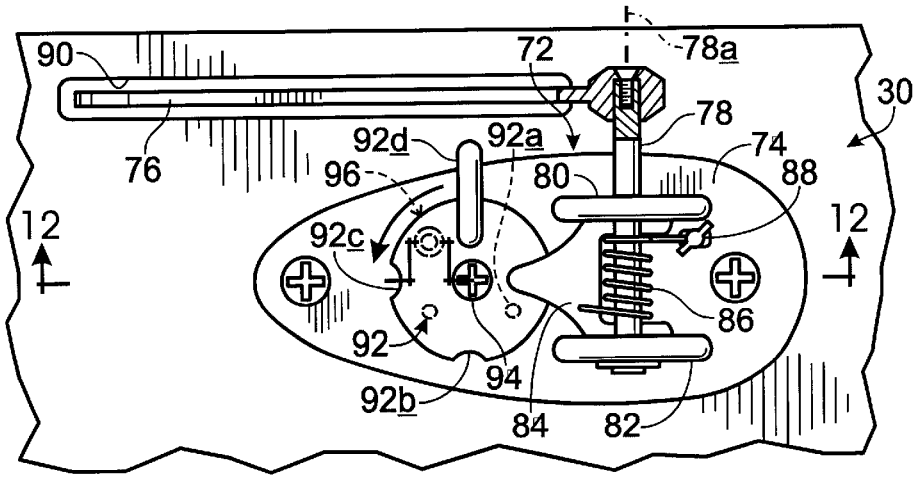
FIG. 11 is a fragmentary plan view, drawn on a larger scale than that used in any of the other drawing figures mentioned so far, illustrating a modified form of skeg structure, wherein a rotary, deployable and moveable skeg blade has its nominal deployment condition controlled by cam and follower structure constructed in accordance with the present invention.
Figure 12:
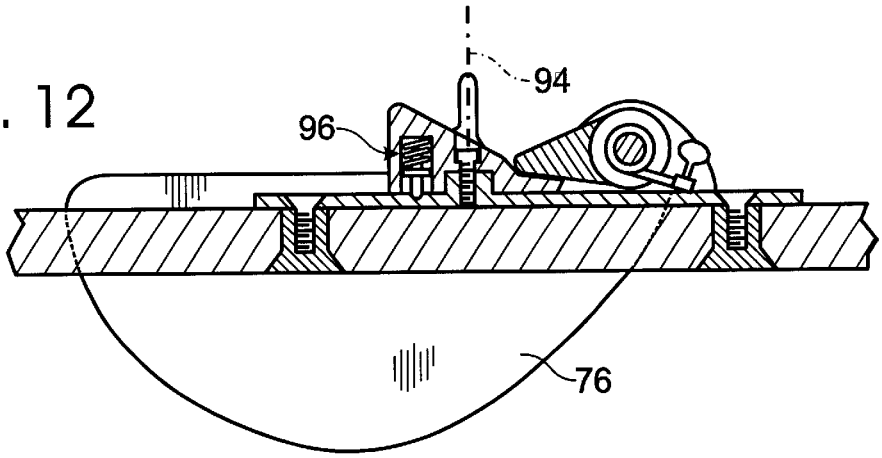
FIG. 12 is a fragmentary cross-sectional view taken generally along the line 12—12 in FIG. 11.

Pictured in FIGS. 11–13, inclusive, is yet another modified form of a pivotal-blade skeg structure constructed in accordance with the present invention. Specifically, these three figures illustrate a structure which features a cam and follower type mechanism for adjusting, selectively, different, nominal skeg-blade deployments relative to a snowboard. In these figures, the snowboard pictured continues to be represented and referred to with reference numeral 30.

Thus, shown generally at 72 in these three figures is a cam and follower skeg structure mounted on board 30 (the rear end of the board) as an add-on to the board. Structure 72 is anchored to the board through a mounting base 74 which, with the exception of certain changes that will be discussed shortly, is the equivalent of the mounting base structure described earlier for skeg structure 32. Shown at 76 is an angularly, rotatably, pivotally deployable skeg blade 76 which is substantially the same in construction as previously discussed blade 38. Blade 76 is anchored in the same kind of positive drive manner described earlier to an end of a rotatable shaft 78 which is supported, for rotation about its long axis 78*a*, in journals 80, 82 that are joined to, and may in fact be an integral part of, base 74.

Anchored to, and for rotation as a unit with, shaft 78 is a radially projecting structure 84, the outer, finger-like portion in which acts as a cam follower in structure 72. A suitable configuration for structure 84 is clearly illustrated in FIGS. 11, 12. Acting as a biasing spring (a rotational biasing spring) in skeg structure 72 is a spring shown at 86. The opposite ends of this spring include one end which acts on follower 84 and another end acting through biasing-force adjustment screw 88 with the upper surface of mounting base 74. Screw 88 is the counterpart of screw 60*a* shown in FIG. 6. It thus performs the function of changing selectively the biasing force which is exerted by spring 86 ultimately on blade 76. As can be seen, blade 76 is mounted for movement, and is deployed, through a slot 90 provided through the body in board 30.

Coacting with follower 84 to form what is referred to herein as a cam and follower structure, is a rotary cam element 92 which is appropriately mounted on and for rotation about axis 92*a* with respect to base 74 at the location generally shown. Axis 92*a* extends generally at a right angle relative to axis 78*a*. The upper cam surface of element 92 is inclined across the upper face of the element, such inclination being clearly pictured in FIG. 12. This cam surface is provided with three elongate, radially disposed quadrature-located indentations, valleys or depressions, such as the three depressions shown at 92*a*, 92*b*, 92*c*. With rotation of cam 92 about its rotational axis 92*a* through manipulation of a finger grippable paddle 92*d* which forms part of the cam element, the undersurface of follower 84, where such undersurface projects essentially radially over the cam element's cam surface (relative to axis 92*a*) moves in relation to the position (the rotational position) of that cam surface. The three indentations just mentioned at 92*a*, 92*b*, 92*c* function to receive and stabilize the projecting outer portion of follower 84 in three different conditions which can be thought of herein as being (1) a full deployment condition, (2) a moderate deployment condition, and (3) a nondeployment condition. Deployment is used in this last statement in relation to whether or not the lower part of blade 76 extends downwardly from the undersurface of board 30. The elements in the cam and follower structure, as such are pictured in FIGS. 11 and 12, are shown in relative conditions wherein blade 76 is fully deployed, and this is the condition specifically visible for blade 76 in FIG. 12.

Referring for a moment to FIG. 13, in this figure, blade 76 is shown in three ways: first, and in solid outline, in its fully deployed condition; second, in dashed lines, in a moderate deployment condition; and third, in dash-dot lines, in a nondeployment condition.

In the full-deployment condition, one can see that the lowermost portion of the blade extends downwardly below the undersurface of board 30 by a distance $D_3$.

With rotation of cam 92 90° in a counterclockwise manner with respect to the point of view taken in FIG. 11, the outer extremity of the cam follower drops into depression 92*b* to define the moderate-deployment condition for blade 76. Such moderate deployment is shown in FIG. 13 with the blade pictured in dashed outline. With this level of deployment, the underextremity of the blade is spaced below the undersurface of board 30 by a distance $D_2$.

With another 90° counterclockwise rotation introduced into cam 92, the outer extremity of the follower drops into depression 92*c*, in which condition blade 76 is substantially non-deployed. This condition is shown in FIG. 13 in dash-dot outline.

On a final note with respect to skeg structure 72, furnished in this structure in accordance with the invention, in the interfacial region between the underside of cam 92 and the upper surface of base 74, there are provided plural, spring-action detent mechanisms, one of which is shown generally in dashed lines at 96 in FIGS. 11 and 12, and each of which conventional in construction. Mechanism 96 includes three, quadrature-displaced detent sockets formed in the upper surface of base 74, and a single, spring-biased, movable plunger 96*a* (see FIG. 12) carried in, and on the underside of, cam 92. Such detent mechanism acts to stabilize the rotational position of cam 92 with the cam positioned in each of the three conditions wherein follower 84 engages a depression in the cam surface.

Figure 14:
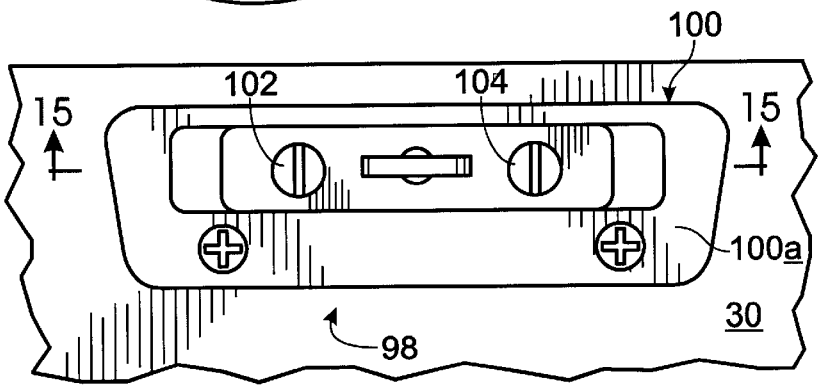
Figure 15:
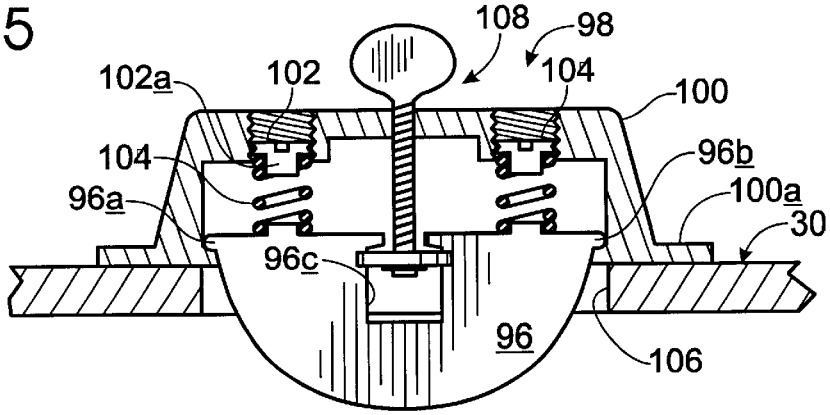

FIGS. 14–16, inclusive, illustrates still another modified form of skeg structure constructed in accordance with the present invention. Here, and speaking just generally, what is shown is a plunger-style, linear-translational-motion (non-arcuate-motion, non-pivotal-motion), skeg structure 98 which is mounted as an add-on to board 30 near the board's rear end. Structure 98 is designed for deployment of a plunger-like skeg blade 99 through an appropriate, accommodating, through-body slot furnished in the board.

Structure 98 includes an overhead housing (also called a guide structure) 100 having a base portion 100*a* that is directly anchored to the upper surface of board 30. Housing 100 is also referred to herein as substructure which defines an environment permitting linear, translational relative motion between blade 99 and board 30. Screwed downwardly into housing 100 from the top surface thereof are two adjustment screws (spring-action adjustment structure) shown at 102, 104. Stems, such as stem 102*a* in screw 102, axially freely receive the upper ends of compression biasing springs, such as spring 105 which is associated with screw 102. The lower ends of these biasing springs acts on the upper portion of blade 99 in structure 98, which skeg blade acts through slot 106 (generally mentioned just immediately above) provided in board 30. Lateral blade extensions such as the two shown at 99*a*, 99*b* for blade 99 in FIG. 15, prevent the blade from passing downwardly completely through and escaping slot 106.

A deployment adjustment screw structure 108, which is formed as an assembly pictured in exploded view in FIG. 16, has a lower-end structure 108*a* which is capturedly received within a suitable receiving space 99*c* in plunger blade 99.

Within skeg structure 98, the amount of nominal deployment chosen for blade 99 is selected by turning, in one direction or the other, the adjustment screw that forms part of structure 108. Structure 108 effectively defines the maximum amount of possible deployment for blade 99 under each adjusted condition, and the blade is urged downwardly, to rest nominally in this selected deployment condition, under the influence of the two compression biasing springs. The level of biasing force exerted downwardly on blade 99 can be adjusted through turning of screws 102, 104 in one direction or another.

When a skeg structure such as structure 98 is put into use, skeg blade deployment chosen by the user is adjusted through manipulation of the parts in deployment adjustment structure 108, and the biasing force exerted by the springs mentioned is adjusted through manipulation of screws 102, 104. With operation and use of a snowboard employing skeg structures like skeg structure 98, when it is necessary for the blade to yield against the biasing action of the associated biasing springs, the blade moves upwardly principally translationally into the downwardly facing chamber within housing 100, against a rising compression in one or both of the biasing springs. An interesting feature of this condition is that yielding movement of blade 99 is both plunger-like (translational) in nature, and in certain instances, rocker-like in character. Such rocker-like behavior is accommodated by the presence of the two, laterally-spaced biasing springs such as spring 104, and this behavior allows the blade to accommodate snow-surface conditions in a specific way which is different from the types of yielding engagement furnished by the previously-described skeg blades.

Turning attention now to FIGS. 17–20, inclusive, here there is shown a very simply constructed, flexible, reed-like, arcuate (but not pivotal) motion, skeg structure which is prepared in accordance with yet another modification of the present invention. In particular, these four figures illustrate a unitary, reed-like skeg structure which includes many fewer components than do the previously described skeg structures.

In FIG. 17, this reed-like skeg structure is designated generally at 110, and looking at FIG. 17 along with the other drawing figures in the collection just mentioned, one can see that this structure 110 is elongate in nature. Structure 110 includes one end 110*a* that forms a "mounting base" for the structure, which end is anchored appropriately to the top surface of board 30. Extending from this mounting end toward the opposite end, structure 110 includes a springy, longitudinally bendable, reed-like expanse 110*b*. The opposite end of structure 110 contains an integral downturned skeg blade 110*c* which moves with non-pivotal arcuate motion with bending of expanse 110*b*.

An appropriate deployment-adjustment screw 112 is threaded into a suitable accommodating bore provided in expanse 110*b*, in such a manner that the lower end of screw 112 can act directly upon the upper surface of board 30 to create a pre-set amount of flex distortion (bend) in expanse 110*b*, thus to establish, variably, the nominal downward deployment of the underside of blade 110*c* through the accommodating slot shown at 114 (in FIG. 17) in board 30.

In this reed-like structure, one can see that, effectively, there is a definitive positive-drive connection that exists between blade 110*c* and the reed-like flexure expanse 110*b* in structure 110. Considering screw 112 along with flexible expanse 110*b*, one can see that these two components coact to furnish both nominal deployment adjustment positioning, and yieldable biasing, for blade 110*c*.

With final attention now directed to FIGS. 21–24, inclusive, these four figures illustrate at 116 another, modified form of an arcuate (but not pivotal), reed-like skeg structure which is similar in many respects to just-described structure 110. However, with regard to structure 116, the manner in which nominal deployment is adjusted is a bit different, and there is added structure present which is effective to change the biasing force exerted through the flexible reed portion of the structure on a skeg blade 116*a* which forms part of the skeg structure. Specifically, two adjustment screw mechanisms 118, 120 are furnished in structure 116 having elongate adjustment screws with lower ends appropriately carrying slider shoes (also called sliders), such as the sliders shown at 118*a*, 120*a* in FIGS. 23, 24, respectively. These sliders are slidably received in a somewhat captured condition within an elongate angular track furnished as shown at 117 in the figures. The sliders associated, respectively, with mechanisms 118, 120 can be slidably adjusted along the length of track 117, and once adjusted, locked against further slidable movement through tuning of the adjustment screws within these mechanisms.

Figure 21:
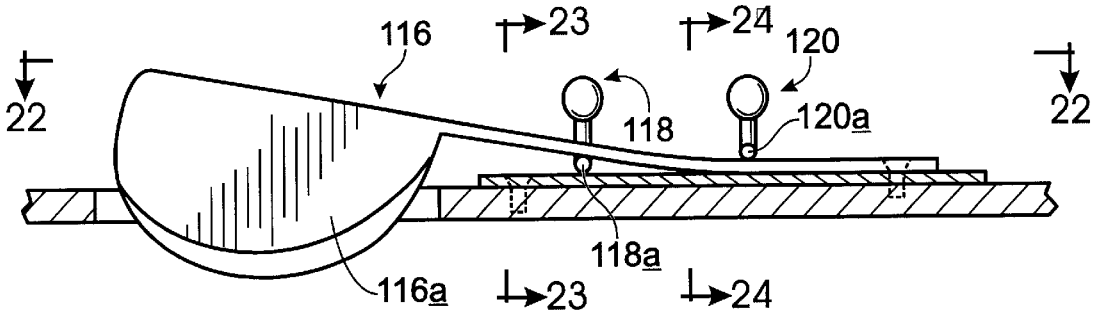
FIGS. 21–24, inclusive, illustrate different views of still another modified form of the invention—this one featuring a skeg blade which forms part of a springy, reed-like structure, and wherein deployment, and deployment biasing-spring force, are independently adjustable through the use of two positionally adjustable sliders. These four figures are prepared in approximately the same drawing scale used in FIGS. 17–20.
Figure 22:
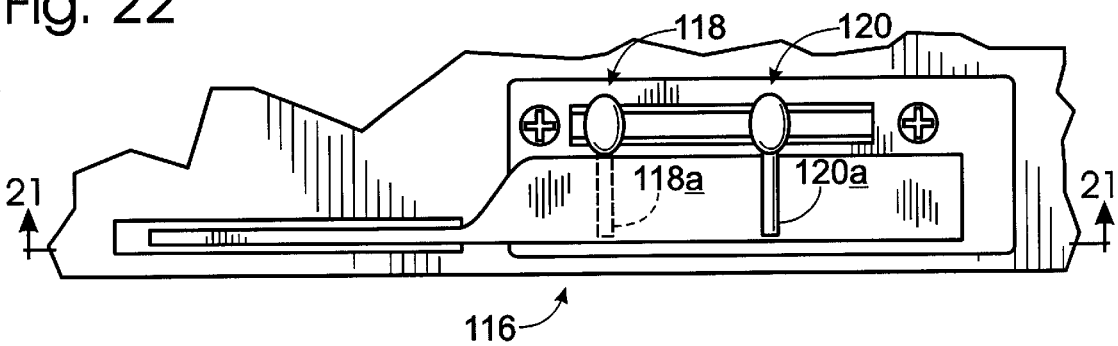
Figure 23:
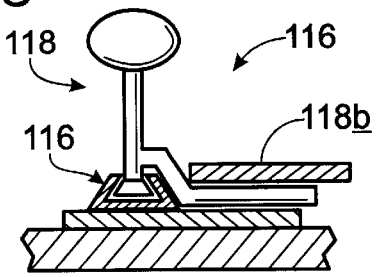
Figure 24:
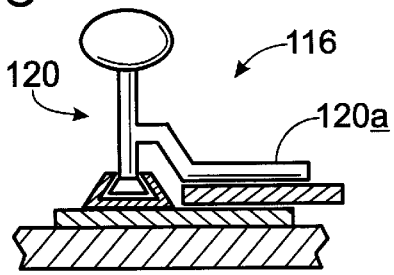

The slider in mechanism 118 extends laterally into a nip region beneath the flexible reed portion of the overall structure in 116, and it will be apparent from a look at FIG. 21, that the lateral position along track 117 of this slider, i.e., its position to the left or to the right along track 117, is effective to produce a bending condition in the skeg flexure region, thus to control the amount of downward nominal deployment of blade 116*a*. By loosening the screw in structure 118, and sliding this structure to the left or to the right along track 116, a selected deployment condition can be created, and then locked into place so-to-speak by tightening of this screw.

Adjustments made in the position along track 117 of the shoe in screw adjustment mechanism 120 effectively lengthens and shortens the active flexure portion of structure 118, thus to change selectively the biasing force which this flexure portion exerts on blade 116*a*.

There is thus proposed by the present invention, illustrated in several particularly useful forms, deployable skeg structure for a snow-traveling device of the types generally illustrated and mentioned. Accurate and reliable deployment-control over a skeg blade (movable generally arcuately, pivotally or linearly) is furnished, with a deployed blade being predictably and appropriately-responsive, in a selected, travel-limited manner, to the instantaneous condition of any engaged snow surface.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

It is desired to claim and secure by Letters Patent:

1. Skeg structure for a snow-traveling device having an underside, snow-contacting surface, said skeg structure comprising anchor structure securable to a snow-traveling device, a skeg blade, and mounting structure mounting said blade on said anchor structure for adjustable, travel-limited, yieldable, spring-biased motion of the blade relative to the anchor structure, such motion, with the skeg structure secured in place on board, occurring within a range of motion which accommodates different amounts of downward blade projection relative to the board's snow-contacting surface.

2. The skeg structure of claim 1, wherein said mounting structure includes substructure which defines such relative motion as an arcuate motion.

3. The skeg structure of claim 2, wherein said substructure defines such arcuate motion as a pivotal motion.

4. The skeg structure of claim 1, wherein said mounting structure includes substructure which defines such relative motion as one including a generally linear, translational motion.

5. The skeg structure of claim 1, wherein said mounting structure includes an elongate rotatable shaft having a skeg-blade-receiving end which, in axial transverse cross-section, is polygonal, and wherein said skeg blade includes a mounting region formed with a polygonal socket sized and configured to receive, in a clearance-fit fashion, said skeg-blade-receiving end in said shaft, said shaft promoting rotary motion of said blade within the mentioned range of motion.

6. The skeg structure of claim 5, wherein said skeg blade includes a mounting region engaged with said mounting structure, and a tapered, broad-area, somewhat planar expanse generally extending from said mounting region, and wherein the taper in said expanse is generally defined by at least a pair of converging planes each of which is disposed approximately normal to the long axis of said shaft.

7. The skeg structure of claim 5, wherein said skeg blade includes a mounting region engaged with said mounting structure, and a tapered, broad-area, somewhat planar expanse generally extending from said mounting region, and wherein the taper in said expanse is generally defined by three converging planes, each of which is disposed roughly normal to the long axis of said shaft, such planes furnishing a differential bevel characteristic to said expanse.

8. The skeg structure of claim 1, wherein skeg blade and mounting structure include a unitary, common, spring-reed component.

9. The skeg structure of claim 8, wherein said mounting structure includes a first adjustable slider moveable between different selectable positions interposed said spring-reed component and said anchor structure for adjusting amount of downward projection.

10. The skeg structure of claim 9, wherein said mounting structure further includes a second adjustable slider moveable between different selectable positions interposed said spring-reed component and said anchor structure for adjusting the level of spring biasing.

11. The skeg structure of claim 1, wherein said mounting structure includes relatively moveable cam and follower structure operable to define the mentioned range of motion permitted said skeg blade relative to said anchor structure.

12. The skeg structure of claim 11, wherein said mounting structure includes an elongate rotatable shaft which promotes rotaly motion of said blade within the mentioned range of motion, and said cam and follower structure includes a follower anchored for movement rotationally as a unit with said shaft, and a rotaly cam element, including a cam surface engaged with said follower, mounted for rotation on and relative to said anchor structure about an axis which is generally at a right angle relative to and spaced from said shaft's long axis.

13. The skeg structure of claim 12, wherein interposed said cam element and said anchor structure is spring-biased detent structure operable to effect releasable catching of said element relative to said anchor structure in plural different angularly-defined positions relative to the anchor structure, in each of which positions interaction between said cam surface and said follower results in placement of said skeg blade in different conditions of downward projection respecting an associated board's snow-contacting surface.

14. The skeg structure of claim 13, wherein said follower has a finger-like projection extending generally radially from said shaft, and said cam surface is formed with elongate depressions each adapted freely to receive said projection under circumstances with said cam element in different respective detent-caught angular positions relative to said anchor structure.

15. The skeg structure of claim 1, wherein said mounting structure includes guide structure generally slidably receiving said skeg blade for linear, plunger-like translational movement throughout the mentioned range of motion.

16. The skeg structure of claim 15, wherein there is further included spring-action adjustment structure operatively interposed said guide structure and said skeg blade, adjustable selectively to vary a spring-biasing force which acts on said blade to urge the same projectively downwardly relative to the board's snow-contacting surface.

17. The skeg structure of claim 16, wherein spring-biasing of said skeg blade is performed by a pair of laterally displaced compression springs which act operatively and effectively between the blade and said base.

18. A selective, variably deployable, travel-reactive skeg structure for a snow-traveling device, of the type having a snow-contacting undersurface, comprising anchor structure suitable for anchoring the overall skeg structure to snow-traveling device, a skeg blade mounted on and for deployment movement and positioning relative to said anchor structure, and deployment biasing and adjustment structure operatively interposed said blade and said anchor structure, including a loadable/unloadable biasing element which is operable, selectively, to create different yieldably biased deployment conditions for said blade, a positive drive-connection structure drivingly interposed said element and said blade to cause the two to function as a unit, and adjustment structure operatively interposed said element and said anchor structure, operable, through said element, to establish a selected, yieldably biased deployment condition for said blade.

* * * * *